US005114569A

United States Patent [19]

Kelsey

[11] Patent Number: 5,114,569

[45] Date of Patent: May 19, 1992

[54] JIG PULSION MECHANISM

[75] Inventor: Christopher G. Kelsey, Sydney, Australia

[73] Assignee: Lowan Management Pty. Limited, South Australia, Australia

[21] Appl. No.: 623,922

[22] PCT Filed: Jun. 28, 1989

[86] PCT No.: PCT/AU89/00279

§ 371 Date: Dec. 20, 1990

§ 102(e) Date: Dec. 20, 1990

[87] PCT Pub. No.: WO90/00090

PCT Pub. Date: Jan. 11, 1990

[30] Foreign Application Priority Data

Jul. 1, 1988 [AU] Australia ..... PI9116

[51] Int. Cl.[5] ..... B03B 5/12

[52] U.S. Cl. ..... 209/425; 209/44; 209/453

[58] Field of Search ..... 209/453, 503, 44, 425, 209/426, 445, 482, 486

[56] References Cited

U.S. PATENT DOCUMENTS

| | | | |
|---|---|---|---|
| 4,056,464 | 11/1977 | Cross | 209/44 |
| 4,071,440 | 1/1978 | Jedo et al. | 209/44 |
| 4,279,741 | 7/1981 | Campbell | 209/44 |
| 4,454,041 | 6/1984 | Kelsey | 209/453 X |
| 4,574,046 | 3/1986 | Sprow | 209/44 |
| 4,898,666 | 2/1990 | Kelsey | 209/44 X |
| 4,998,986 | 5/1991 | Campbell | 209/453 X |

FOREIGN PATENT DOCUMENTS

| | | | |
|---|---|---|---|
| 8604269 | 7/1986 | World Int. Prop. O. | 209/453 |

*Primary Examiner*—Donald T. Hajec

*Attorney, Agent, or Firm*—Beveridge, DeGrandi & Weilacher

[57] ABSTRACT

A centrifugal jig of the type in which a feed slurry is introduced into a rotating chamber bounded radially by a screen provided with ragging on its inner surface. The ragging is repetitively dilated in a circumferential sequence while the container rotates.

21 Claims, 9 Drawing Sheets

JIG PULSION MECHANISM

BACKGROUND ART

This invention relates to centrifugal jigs of the general type described in Australian Patent No. 573,960, in which a feed slurry is introduced into a rotating chamber bounded radially by a screen provided with ragging on its inner surface, the ragging being dilated repetitively to provide jigging action. The jig separates the materials in the feed slurry on the basis of differing specific gravities.

Centrifugal jigs according to Australian Patent No. 573,960 have proven to be highly effective, and are capable of separating materials having a specific gravity difference as low as 0.4. However, these jigs have been mainly restricted to relatively small units. Practical difficulties prevent this jig design being used for large scale jigs. In particular, the forces needed to overcome the hydrostatic pressure and pulse the water in a large hutch region would interfere with the balanced running of a large scale jig.

DISCLOSURE OF INVENTION

The present invention seeks to obviate the abovementioned difficulties by providing a centrifugal jig in which large throughputs of material can be obtained, with an efficient mechanism for dilating the ragging.

The present invention therefore provides a centrifugal jig comprising a container mounted for rotation about its longitudinal axis, the container comprising an axial region, a peripheral region comprising at least one hutch chamber separated from the axial region by ragging, means for introducing feed material to the axial region and dilating means for repetitively dilating the ragging in a circumferential sequence while the container rotates.

Preferably, the vector sum of the radial forces acting on the dilating means due to hydrostatic pressure of fluid within the hutch chambers is zero, thus providing a jig in which the hydrostatic pressures are balanced.

The peripheral region may comprise a plurality of hutch chambers each separated from the axial region by ragging and the dilating means may comprise pulsating means associated with each hutch chamber for pulsating the fluid in the respective hutch chamber.

More preferably, the hutch chambers are circumferentially spaced about the longitudinal axis in diametrically opposed pairs and, in use, the force acting on the pulsating means due to hydrostatic pressure of fluid in a hutch chamber is counter-balanced by an equal and opposite force on the pulsating means due to hydrostatic pressure of fluid in the diametrically opposed hutch chamber. The pulsating means may sequentially pulsate the fluid in circumferentially successive hutch chambers, and may simultaneously increase the pressure of fluid in a hutch chamber and decrease the pressure of fluid in the diametrically opposed hutch chamber.

An alternative means for sequentially dilating the ragging comprises providing separate screen portions corresponding to each hutch chamber, the screen portions being reciprocated while the container rotates. A further alternative means for sequentially dilating the ragging comprises mounting the screen eccentrically to the longitudinal axis of the container.

To allow continuous throughput of material, the jig may have concentrate outlet means communicating with the radially outermost portion of each of the hutch chambers and concentrate launder means communicating with the concentrate outlet means. The jig may also have a flange extending radially inwardly from the upper edge of the screen and tailing launder means communicating with the region above and radially inward of the flange.

The pulsating means for each hutch chamber preferably comprises a diaphragm actuated by reciprocating drive means. The reciprocating drive means may comprise a pushrod associated with each of the diaphragms and crank means for reciprocating each of the pushrods.

Preferred embodiments of the present invention shall now be described with reference to the accompanying drawings:

Figure 1:
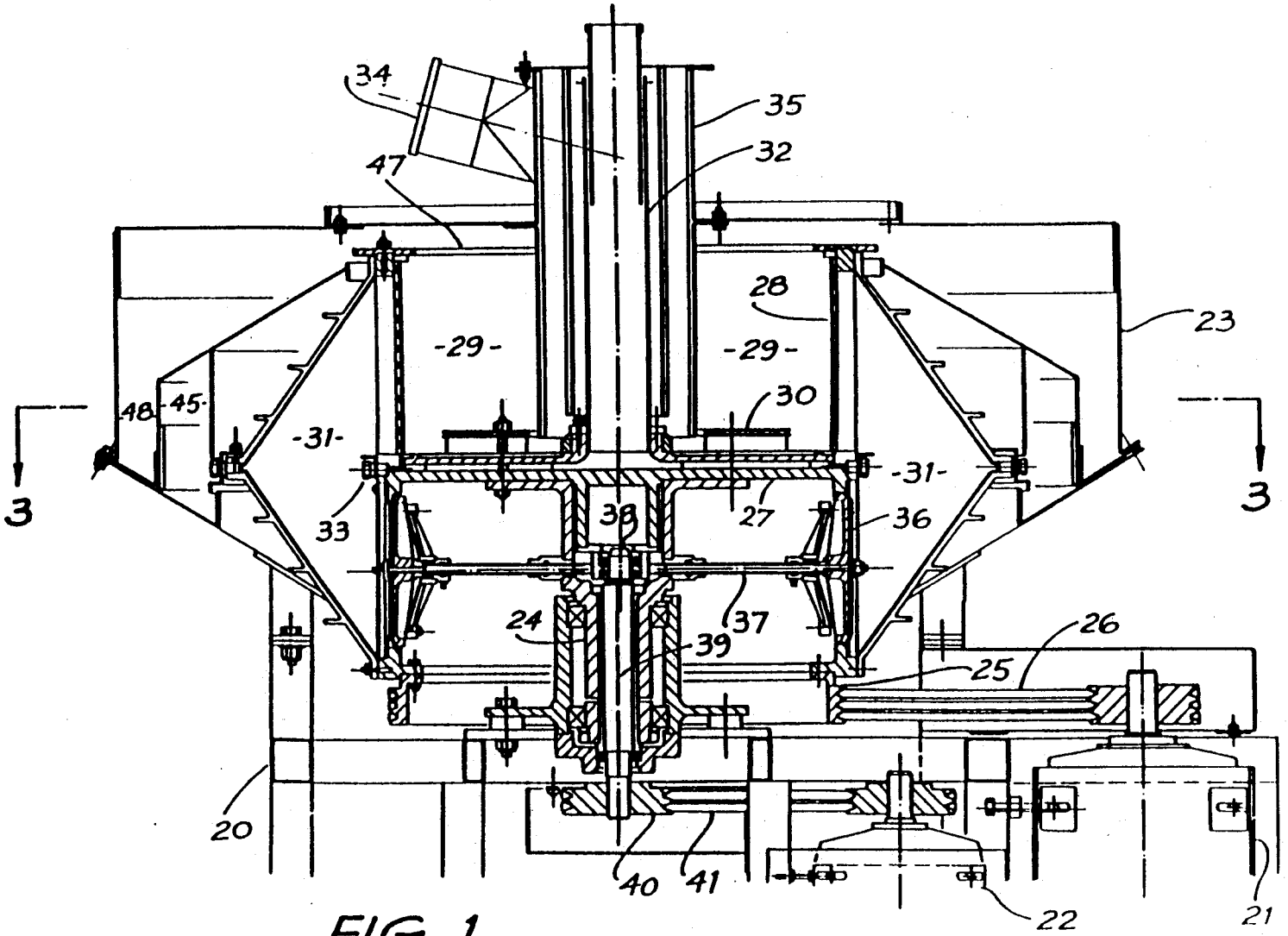
FIG. 1 is a simplified sectional elevation of a centrifugal jig according to one embodiment of the present invention.
Figure 2:
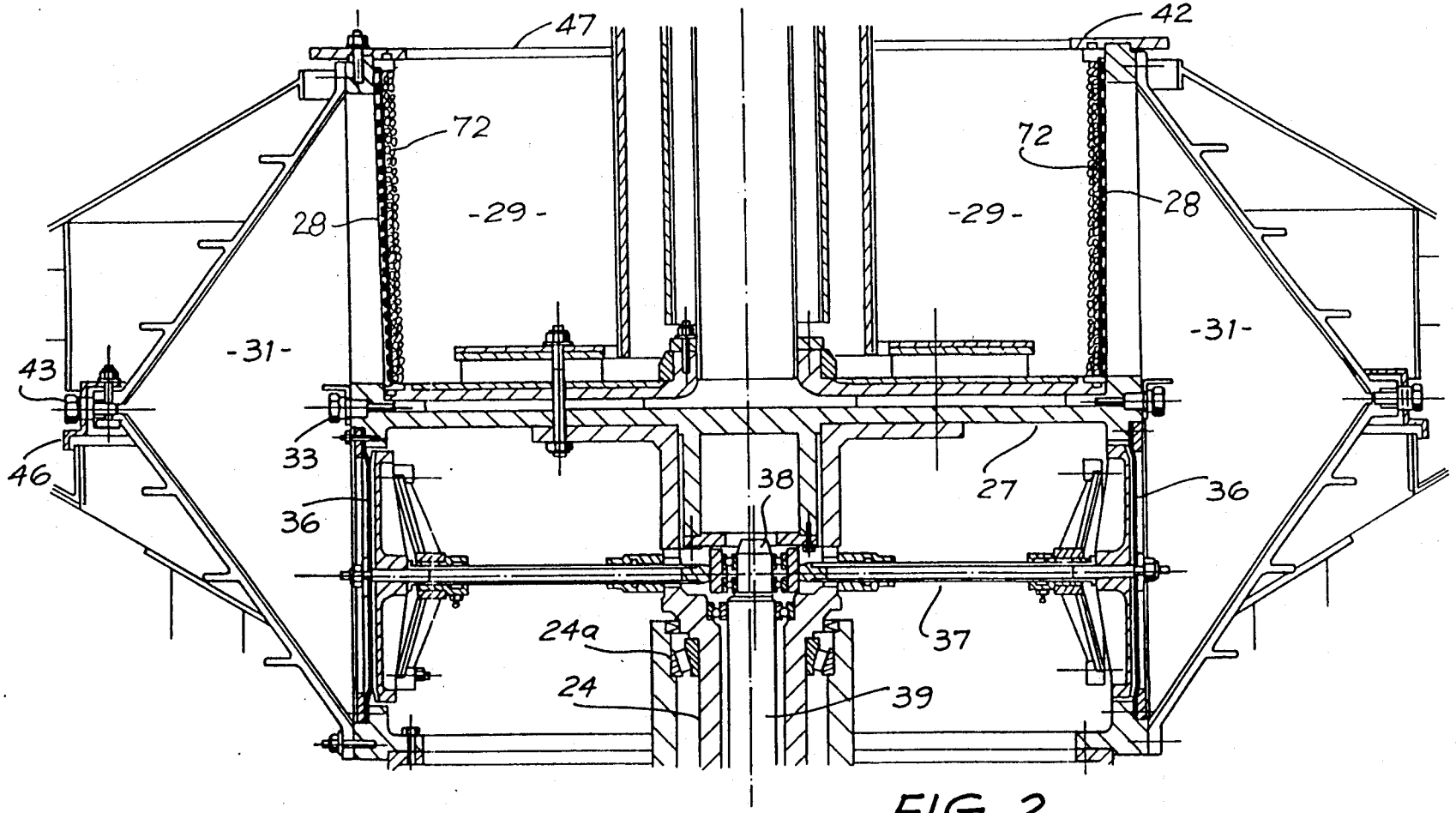
FIG. 2 is a sectional elevation of part of the jig of FIG. 1.

The jig illustrated in FIGS. 1 & 2 comprises frame 20 supporting a jig drive motor 21, a crank drive motor 22, a fixed launder arrangement 23 and a jig main shaft 24, the latter being supported in bearings 24*a*.

The main shaft is driven by the jig drive motor through jig drive pulley 25 and jig drive belt 26. Mounted on the main shaft is a pulsator and screen housing 27 comprising a screen 28 defining an inner chamber 29, a feed impeller 30 located in the lower portion of the inner chamber and a number of hutch chambers 31 circumferentially spaced about the screen.

Water is provided to the hutch chambers through make-up tube 32 and make-up water nozzles 33. Feed slurry is provided to the inner chamber through feed pipe 34, feed tube 35 and the feed impeller 30.

Each hutch chamber is provided with a diaphragm 36 to pulsate the water in the respective hutch chamber. The diaphragm is actuated by a pushrod 37 which is reciprocated by a crank 38. Crankshaft 39 is mounted for independent rotation within the hollow main shaft 24 and is driven by the crank drive motor through crank drive pulley 40 and crank drive belt 41.

The manner of operation and the design of the feed inlet and screen parts of the jig correspond generally with those of the jig described in the abovementioned Australian Patent and will be described only briefly here.

Ragging material 72 shown in FIG. 2, such as run-of-mill garnet, aluminium alloy or lead glass balls, is provided on the inner surface of the screen. In the interest of clarity, the ragging material 72 is not shown in the other drawings. The ragging is held against the surface of the screen due to the rotation of the jig. The feed slurry entering the inner chamber through the feed impeller migrates upwardly against the inner surface of the ragging.

As discussed in the abovementioned Australian Patent, the screen is preferably shaped as a paraboloid of revolution which is contoured such that the interface between the ragging and the feed material lies on a surface of revolution of substantially constant pressure. However, for convenience, the screen is shown here as a cylinder. Where the radius of the inner chamber 29 does not allow convenient use of a single screen, a series of screens may be provided about the periphery of the chamber. Screen retainer plate 42 extends inwardly for a short distance to define the thickness of the ragging and feed material.

The ragging is repetitively dilated by pulsing the water in each hutch chamber. The dilation of the ragging allows the higher specific gravity material in the feed slurry to pass through the ragging and the screen and enter a hutch chamber. The concentrate material then travels to the radially outermost part of the hutch chamber and passes through outlet spigot 43, which is aligned with a gap 44 in the inner wall of a concentrate launder 45. A splash guard 46 is provided to prevent loss of the concentrate material.

Of course, some of the water in each hutch chamber is lost with the concentrate, and this water is continuously replenished with make up water from the water supplied to the make up water nozzles. The nozzles 33 should extend radially beyond the screen by a distance which is sufficient to place the nozzle orifice at a hydrostatic pressure which is greater than the pressure at the ragging by an amount which is sufficient to ensure that ragging dilation is caused by the pulsion of the hutch water, rather than merely driving make-up water back up the tube. A pressure difference in the region of 5 lb $in^{-2}$ has been found adequate for this purpose.

The lower specific gravity material in the feed slurry does not pass through the ragging, but passes upwardly and escapes past the open top 47, which is radially inward of the inner surface of the screen retainer plate 42 and then to tailings launder 48.

Figure 3:
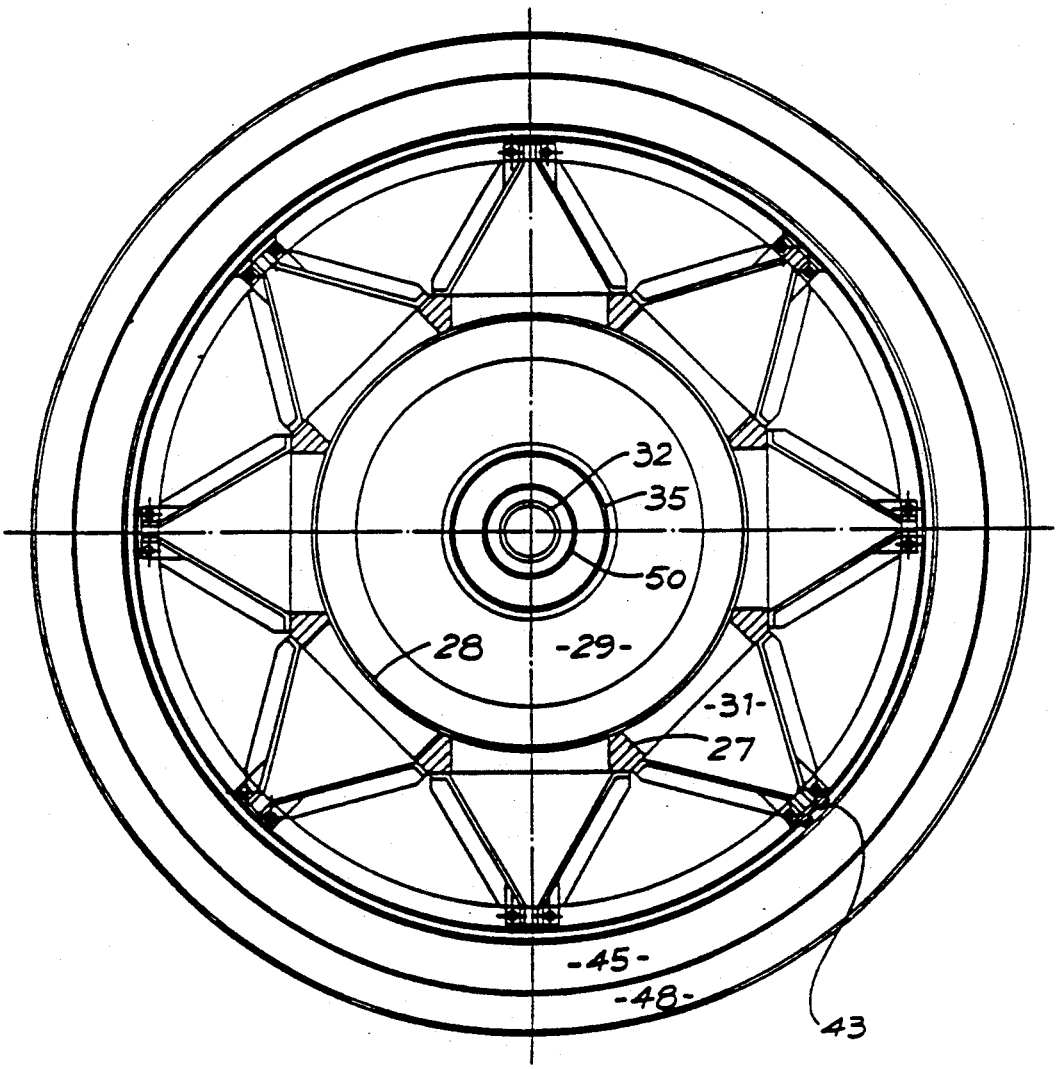
FIG. 3 is a sectional plan view taken through line 3—3 of FIG. 2.
Figure 4:
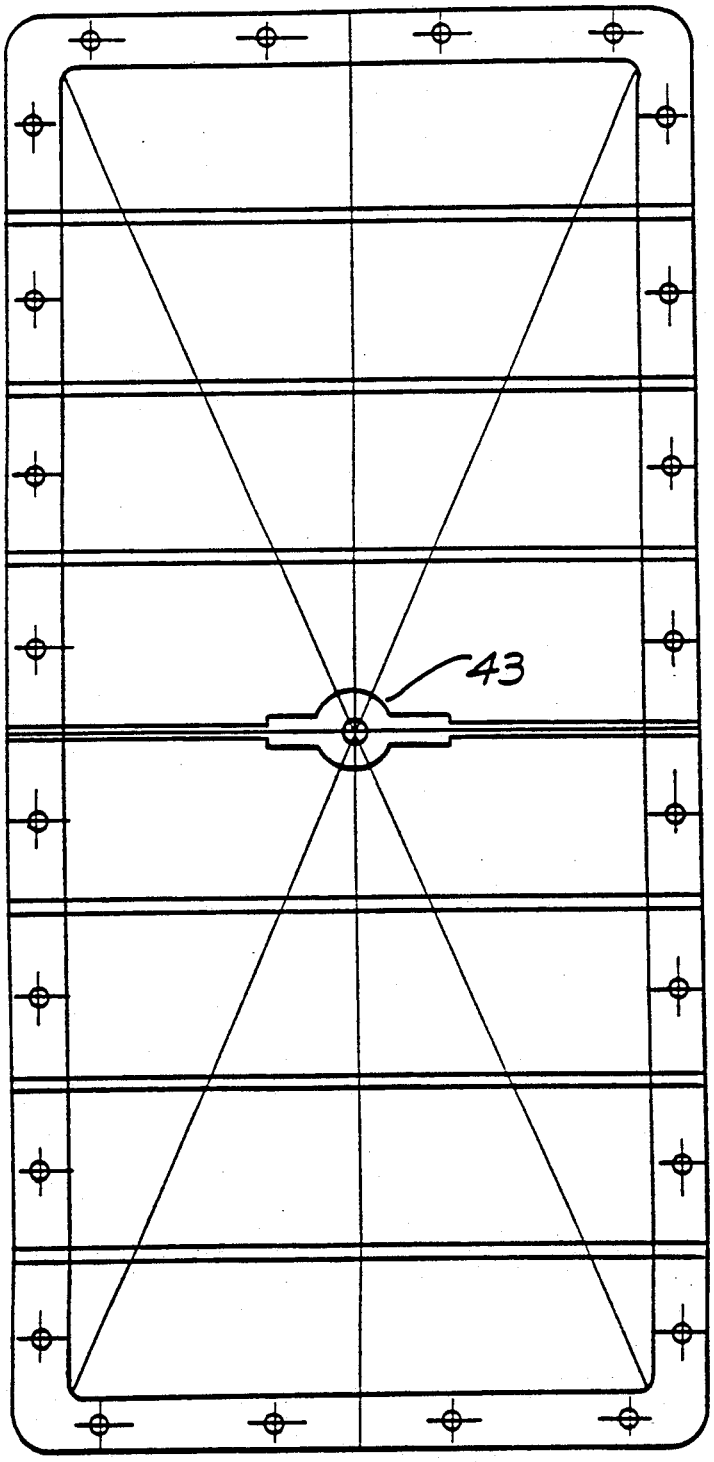
FIG. 4 is a side elevation of a hutch chamber in the jig of FIG. 1.

As apparent from FIGS. 3 & 4, the hutch chambers 31 are preferably formed as rectangular pyramids which are supported by the pulsator and screen housing 27 and are circumferentially spaced about the outer surface of the screen. The outlet spigots 43 are located at the apex of each hutch chamber.

Figures 5, 6:
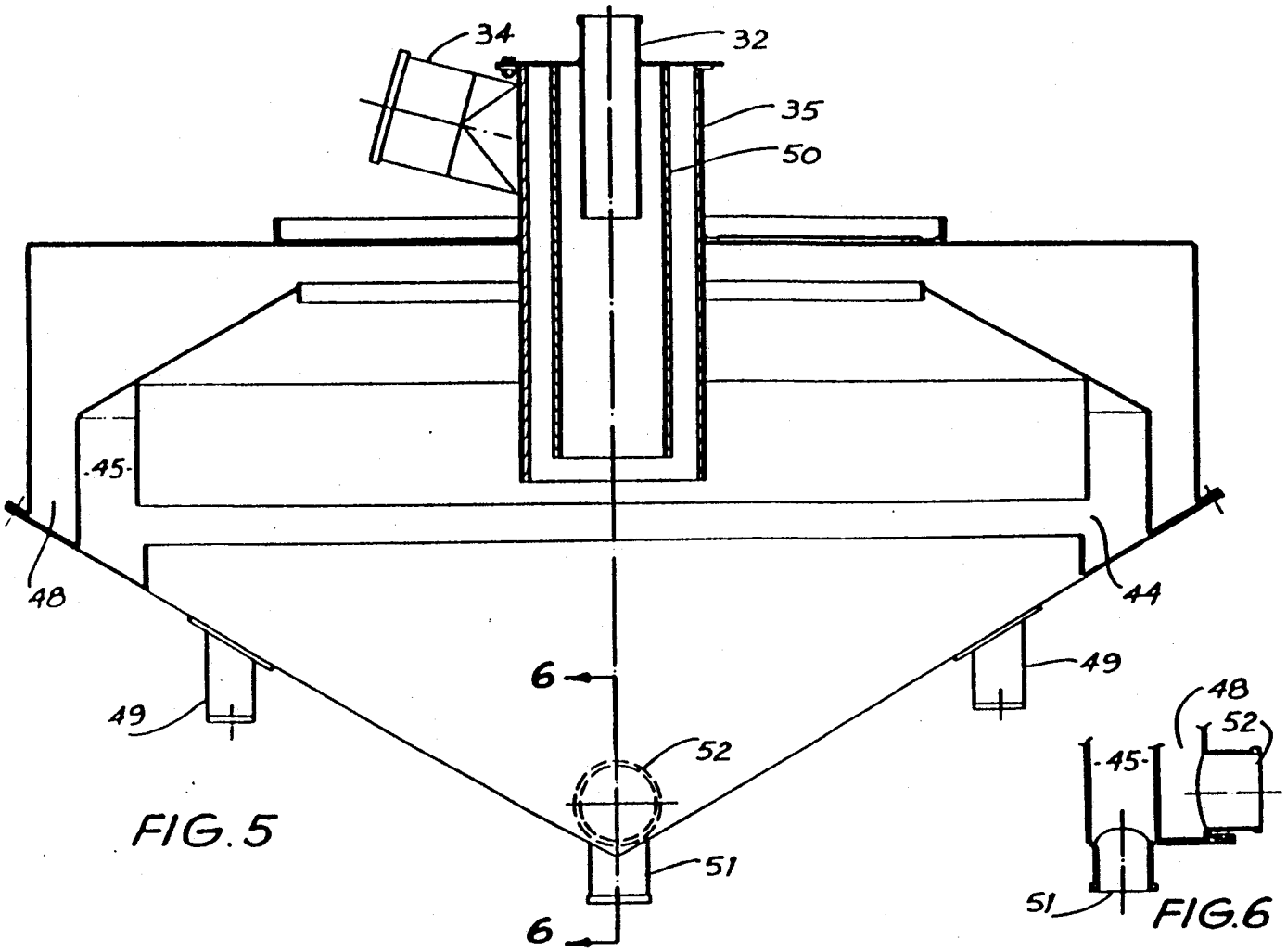
FIG. 5 is a sectional elevation of the launders arrangement in the jig of FIG. 1.
FIG. 6 is a sectional elevation taken through line 6—6 of FIG. 5.

FIGS. 5 & 6 illustrate a preferred launder arrangement. The launders are supported by frame members 49 and in turn support the feed pipe 34, feed tube 35, and the upper portion of the make-up water tube 32. Replaceable wear tube 50 is provided to prevent the feed slurry from eroding the make up water tube. The feed tube and wear tube may be lined to minimise erosion. The launder arrangement illustrated has the tailings launder surrounding the concentrate launder. Concentrate outlet 51 and tailings outlet 52 are located at the lowest points of the respective launder.

Figure 7:
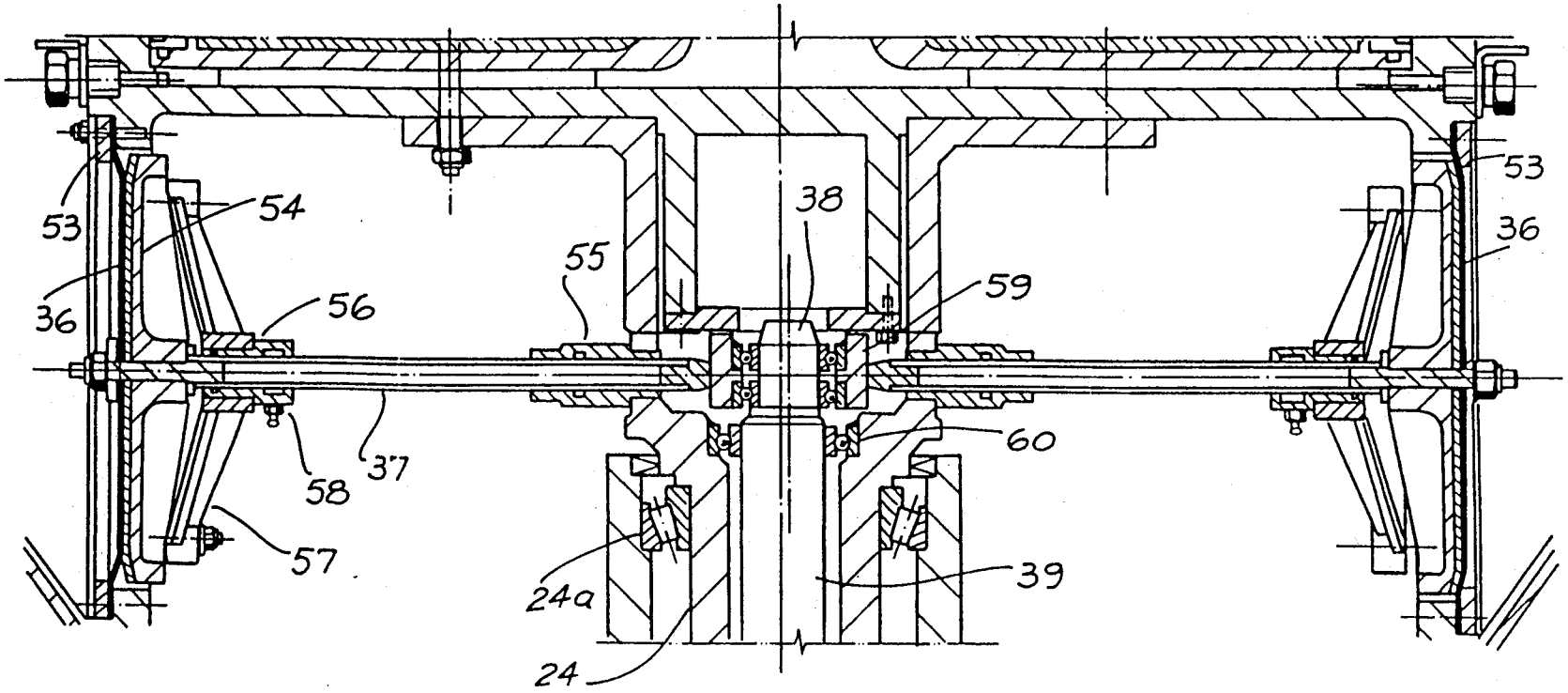
FIG. 7 is a sectional elevation of part of the reciprocating drive arrangement and diaphragm retainer arrangement in the jig of FIG. 1.

FIG. 7 illustrates a preferred reciprocating drive means. The diaphragms 36 for pulsating the water in the hutch chambers are retained within apertures in the inner walls of each hutch chamber by diaphragm retainer rings 53. The diaphragms are actuated by pistons 54 connected to the push rods 37 which are mounted to rotate with the jig by guides 55 & 56. In the embodiment illustrated, guide 55 is screwed into the main shaft 24 while guide 56 has four arms 57 which are attached to the housing. Guide 56 may be provided with a grease nipple 58 to allow lubrication. Of course, guides 55 & 56 may be extended to form an annular sleeve surrounding each pushrod.

The pushrods are reciprocated within the guides by a cam roller 59 mounted on the crank 38 driven by the crankshaft 39. The crankshaft is mounted for independent rotation within the hollow main shaft by bearings 60 and is driven by the crank drive motor. The diaphragm on the left in FIG. 7 is shown in its retracted position. The diaphragm in the opposite hutch chamber is in its extended position.

As the crankshaft is rotated, the crank and the cam roller rotate eccentrically to the axis of the crankshaft and cause the pushrods to reciprocate within their guides. In this way, as the jig rotates by means of the main shaft and the crank rotates eccentrically with the crank shaft, circumferentially successive diaphragms are moved outwardly and then inwardly, pulsing successive hutch chambers around the jig, providing a smooth and balanced operation, with close coupling between each diaphragm and its chamber. In particular, the hydrostatic pressure acting against any given diaphragm, which must be overcome in producing pulsion, will be counter-balanced by the hydrostatic pressure on the diametrically opposite diaphragm, so that unlike the arrangements described in the prior art, the diaphragms of the present invention are required only to overcome the inertia of the hutch water in producing pulsion therein. This represents a significant saving in energy, and results in smooth and balanced running of the jig.

If even greater smoothness of running is required, at the expense of simplicity, a double crank may be substituted for the single crank.

Since hydrostatic pressure on the diaphragm will hold the push rods against the cam roller when the jig is rotating with hutch water, no special arrangements are required to bias the push rod against the roller.

In many applications, a pressure increase of less than 1 lb in $^{-2}$ will be sufficient to dilate the ragging material. The pushrods may reciprocate at a frequency in the order of 1,500 strokes per minute, although the stroke rate and the eccentricity of the crank may be varied to give optimum performance for the materials to be separated.

Figure 8:
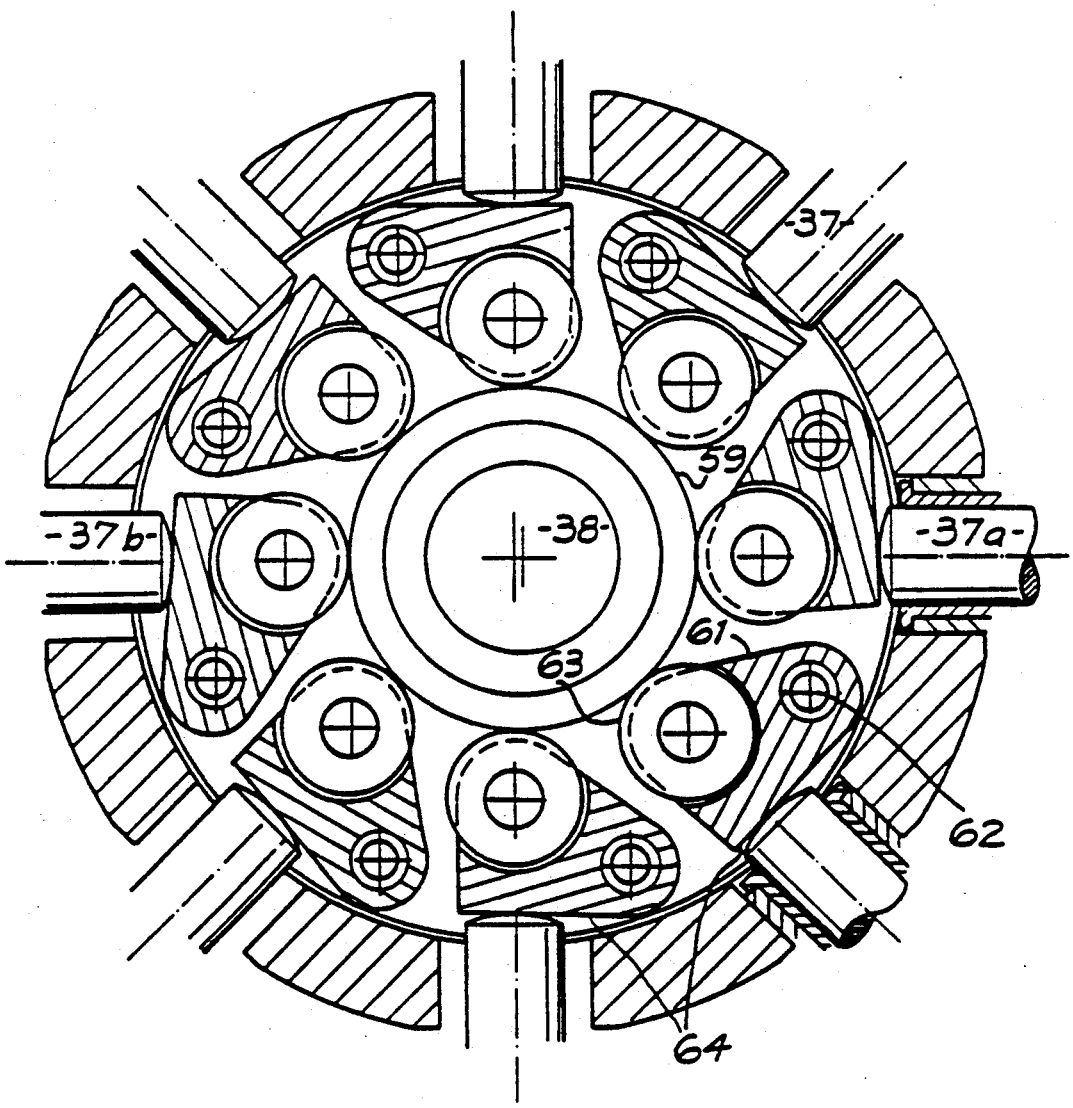
FIG. 8 is a sectional plan view of part of an alternative reciprocating drive arrangement.

FIG. 8 illustrates an alternative crank assembly which minimises wear on the inner ends of the pushrods. A cam roller 59 is mounted on the crank 38 and a series of follower assemblies 61 are mounted for rotation with the main shaft 24 and pushrods 37. Each follower assembly pivots about a pivot pin 62 and has a roller 63 in contact with the cam roller and a bearing surface 64 in contact with the inner end of the corresponding pushrod.

The follower assemblies are held against the cam roller due to the hydrostatic pressure of fluid in the hutch chambers. As the crank rotates relative to the main shaft each roller follows the surface of the cam roller and each pushrod is reciprocated by the bearing surface of the corresponding follower assembly. Thus, in FIG. 8, pushrod **37*a* is shown in its extended position while pushrod 37*b*** is shown in its retracted position. As there is no relative rotation between each pushrod and its corresponding bearing surface, wear on the ends of the pushrods is minimised.

Figure 9:
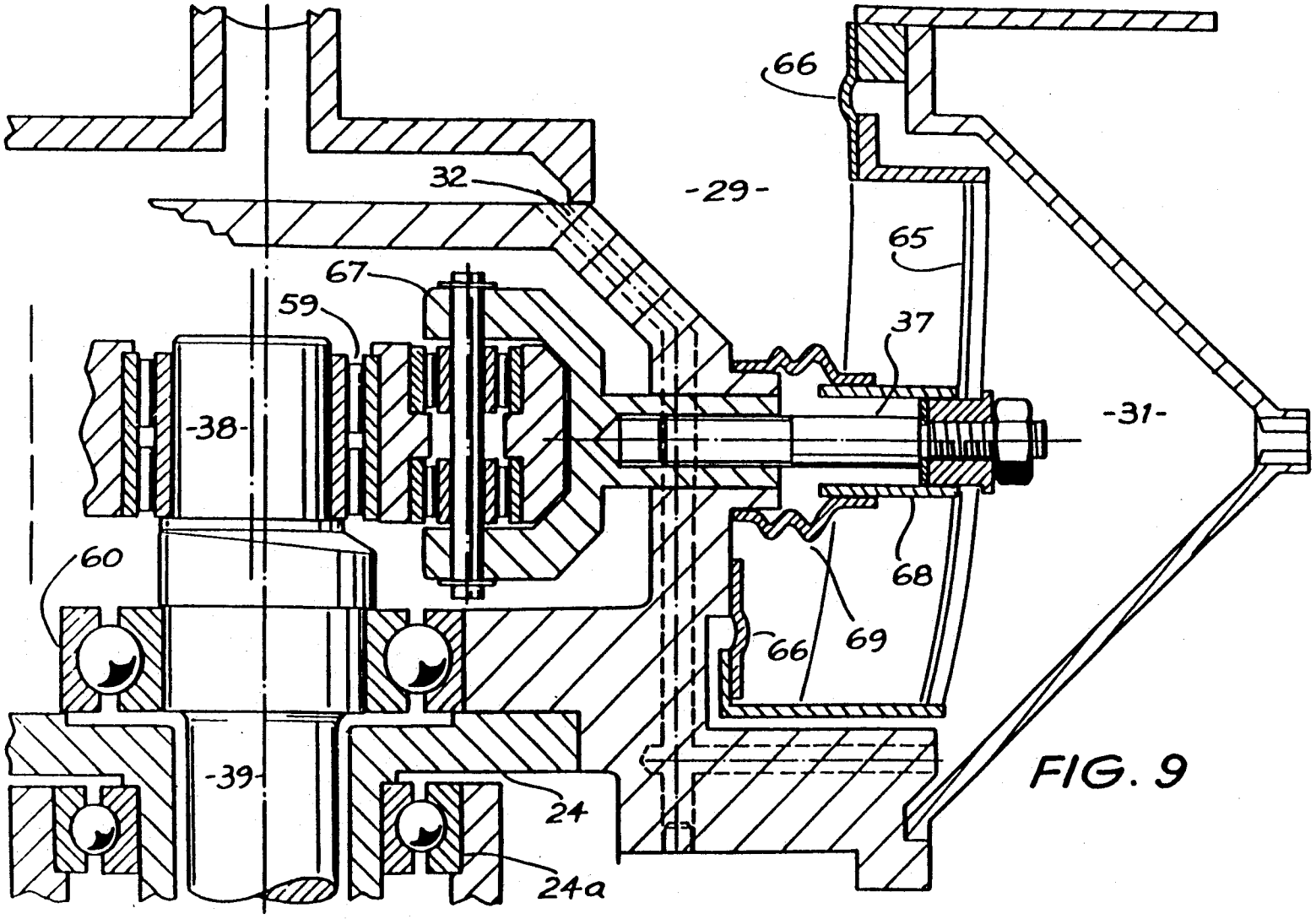
FIG. 9 is a simplified sectional elevation of an alternative arrangement for dilating the ragging.

FIG. 9 illustrates an embodiment in which screen portions 65 are reciprocated by pushrods 37. Each screen portion is supported by flexible seals 66 to rotate with the corresponding hutch chamber 31 and the main shaft 24, which is supported by bearings 24*a*. The crankshaft 39 is mounted for independent rotation within the main shaft by bearings 60. A cam roller 59 is mounted on the crank 38 and each pushrod is provided with a follower assembly 67 which follows the surface of the cam roller. As the crank is rotated relative to the main shaft the pushrods are reciprocated by the follower assemblies and the ragging (not shown) is repetitively dilated.

The feed slurry enters through the open upper end of the inner chamber 29 while water is provided to the hutch chambers through make-up water tubes 32, which are radially displaced from the pushrods and are depicted by dashed lines. Each pushrod has a sleeve 68 and flexible seal 69 to prevent abrasion by the slurry.

Figure 10:
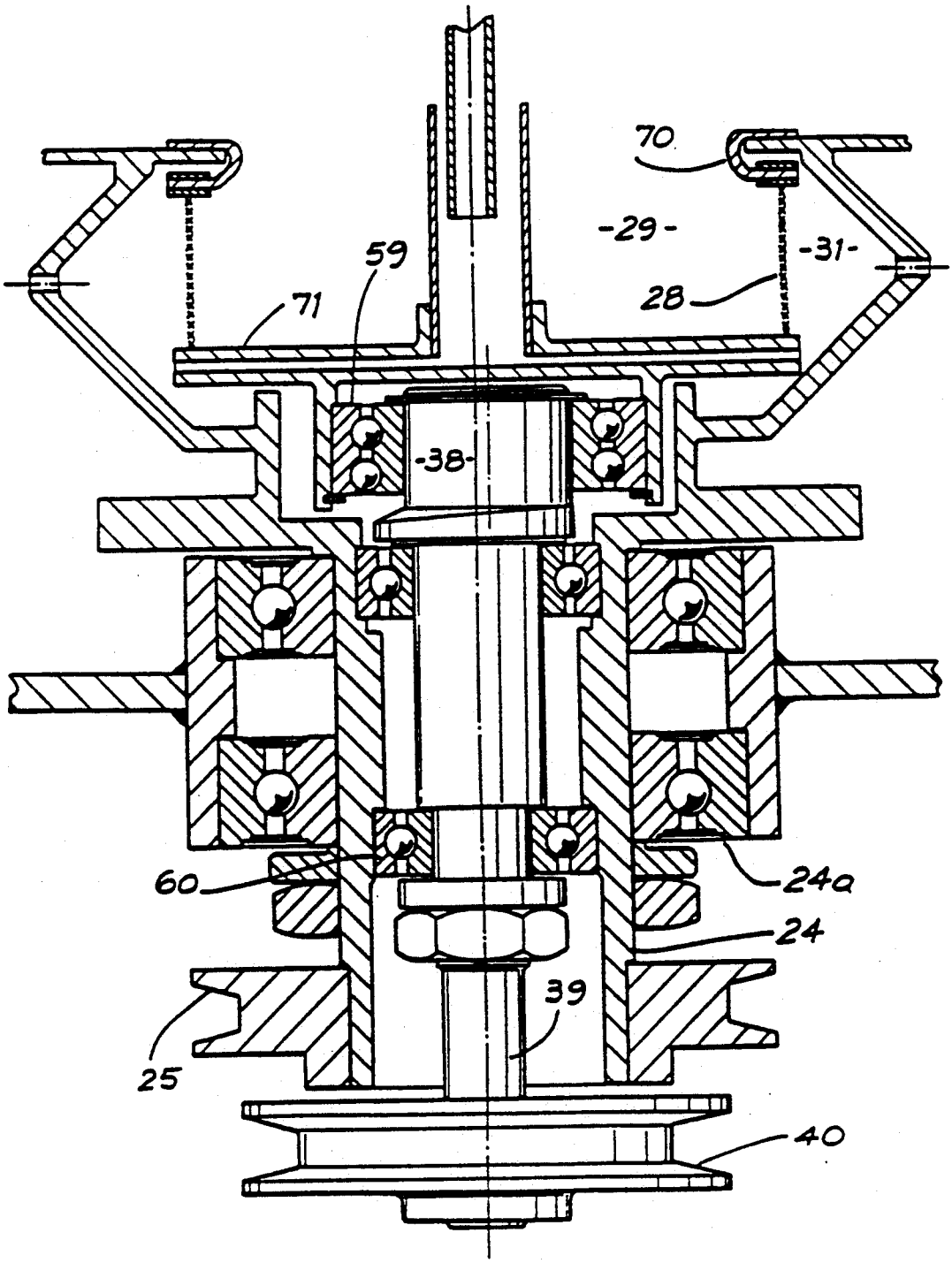
FIG. 10 is a simplified sectional elevation of a jig including a further alternative arrangement for dilating the ragging.

The jig of FIG. 10 also has a screen 28 defining an inner chamber 29 and at least one hutch chamber 31. The screen is suspended by a flexible seal 70 to rotate with the hutch chamber and main shaft 24, which is supported in bearings 24*a*. Like the embodiments of FIGS. 1 to 9, the main shaft is driven through jig drive pulley 25 and a crankshaft 39 is supported in bearings 60 and driven through crank drive pulley 40. The lower end of the screen is attached to the floor and make-up tube assembly 71 which is mounted on a cam roller 59 which is, in turn, mounted on the crank 38.

In use, the screen generally rotates with the hutch chambers and main shaft while the longitudinal axis of the screen 28 rotates with the crank about the longitudinal axis of the jig. Each point on the surface of the screen therefore rotates in a larger radius circle with the hutch chambers and rotates in a smaller radius circle with the crank, thus travelling along an epicyclic path. The ragging is dilated in a wave which travels about the circumference of the screen.

In a further embodiment (unillustrated), the jig is generally arranged as shown in FIGS. 1 to 7 but with the pushrods and diaphragms replaced by a drum mounted on the cam roller, the outer wall of the drum forming part of the inner wall of each hutch chamber. As the crank rotates, the volume of each hutch chamber varies thus pulsating the fluid in each hutch chamber.

I claim:

1. A centrifugal jig comprising a container mounted for rotation about its longitudinal axis, the container comprising an axial region, a peripheral region comprising at least one hutch chamber separated from the axial region by ragging, means for rotating said container, means for introducing feed material to the axial region and dilating means for repetitively dilating the ragging in a circumferential sequence while the container rotates.

2. A jig according to claim 1 wherein said peripheral region comprises a plurality of hutch chambers each separated from the axial region by said ragging.

3. A jig according to claim 2 wherein said dilating means comprises means associated with each hutch chamber for pulsating fluid in the respective hutch chamber.

4. A jig according to claim 3 wherein the hutch chambers are circumferentially spaced about said longitudinal axis in diametrically opposed pairs and, in use, the force acting on the pulsating means due to hydrostatic pressure of fluid in a hutch chamber is counterbalanced by an equal and opposite force on the pulsating means due to hydrostatic pressure of fluid in the diametrically opposed hutch chamber.

5. A jig according to claim 3 wherein the pulsating means simultaneously increases the pressure of fluid in a hutch chamber and decreases the pressure of fluid in the diametrically opposed hutch chamber.

6. A jig according to claim 5 wherein said pulsating means sequentially pulsates circumferentially successive hutch chambers.

7. A jig according to claim 3 wherein each said pulsating means comprises diaphragm means.

8. A jig according to claim 7 wherein said pulsating means further comprises reciprocating drive means for actuating said diaphragm means.

9. A jig according to claim 8 wherein said reciprocating drive means comprises a pushrod associated with each of said diaphragms and crank means for reciprocating each of said pushrods.

10. A jig according to claim 9 wherein said crank means comprises a crankshaft mounted for independent rotation relative to said hutch chambers, means for driving said crankshaft and a crank adjacent an end of said crankshaft for reciprocating each of said pushrods, and wherein said pushrods extend radially outwardly from said crank.

11. A jig according to claim 9 wherein a pushrod associated with one hutch chamber is retracted as a pushrod associated with an opposing hutch chamber is extended.

12. A jig according to claim 2 in which an outer radial surface of the ragging is restrained by a screen comprising a plurality of screen portions each corresponding to a hutch chamber, wherein the repetitive dilation of the ragging is actuated by reciprocating said screen portions.

13. A jig according to claim 12 wherein each said screen portion is reciprocated by a radial pushrod which is actuated by crank means.

14. A jig according to claim 1 wherein an outer radial surface of the ragging is restrained by a screen which is mounted eccentrically to the longitudinal axis of the container.

15. A jig according to claim 14 wherein each point on the screen travels in an epicyclic path when the container rotates.

16. A jig according to claim 15 wherein the screen is mounted on a crank mounted for independent rotation relative to said container.

17. A jig according to claim 2 further comprising concentrate outlet means communicating with the radially outermost portion of each of said hutch chambers and concentrate launder means communicating with said concentrate outlet means.

18. A jig according to claim 17 wherein an outer radial surface of the ragging is restrained by a screen, further comprising a flange extending radially inwardly from the upper edge of said screen and tailing launder means communicating with the region above and radially inward of said flange.

19. A centrifugal jig comprising a container mounted for rotation about its longitudinal axis, the container having an axial region and a peripheral region which includes a plurality of hutch chambers each separated from the axial region by ragging, means for rotating said container, means for introducing feed material to the axial region, and dilating means for repetitively dilating the ragging by pulsating fluid in different ones of said hutch chambers at different times.

20. A method of separating components of a feed material on the basis of specific gravity in a container of a centrifugal jig which has an axial region and a peripheral region which includes at least one hutch chamber separated from the axial region by ragging, comprising the steps of rotating the container about its longitudinal axis, introducing the feed material to the axial region and repetitively dilating the ragging in a circumferential sequence.

21. A method of separating components of a feed material on the basis of specific gravity in a container of a centrifugal jig which has an axial region and a peripheral region which includes a plurality of hutch chambers each separated from the axial region by ragging, comprising the steps of rotating the container about its longitudinal axis, introducing the feed material to the axial region, and repetitively dilating the ragging by pulsating fluid in different ones of said hutch chambers at different times.

* * * * *